US005615656A

United States Patent [19]

Mathis

[11] Patent Number: 5,615,656

[45] Date of Patent: Apr. 1, 1997

[54] FUEL-INJECTION SYSTEM FOR AN INTERNAL COMBUSTION ENGINE, IN PARTICULAR FOR A DIESEL MOTOR, AND A METHOD FOR MONITORING THE SAME

[76] Inventor: Christian Mathis, Muttaweg 16, P.O. Box 244, CH-7250 Klosters-Platz, Switzerland

[21] Appl. No.: 381,219

[22] Filed: Jan. 31, 1995

[30] Foreign Application Priority Data

Feb. 3, 1994 [CH] Switzerland ..... 315/94

[51] Int. Cl.[6] ..... F02M 7/00

[52] U.S. Cl. ..... 123/447; 123/468

[58] Field of Search ..... 123/456, 446, 123/447, 198 D, 468, 469

[56] References Cited

U.S. PATENT DOCUMENTS

| | | | |
|---|---|---|---|
| 3,908,621 | 9/1975 | Hussey | 123/447 |
| 4,364,360 | 12/1982 | Eheim et al. . | |
| 4,565,172 | 1/1986 | Hoshi . | |
| 4,722,708 | 2/1988 | Baltz | 123/468 |
| 4,884,545 | 12/1989 | Mathis | 123/446 |
| 4,911,127 | 3/1990 | Perr | 123/446 |
| 5,076,242 | 12/1991 | Parker | 123/468 |
| 5,176,122 | 1/1993 | Ito | 123/447 |
| 5,230,613 | 7/1993 | Hilsbos et al. . | |
| 5,299,541 | 4/1994 | Yamaguchi | 123/468 |

FOREIGN PATENT DOCUMENTS

| | | | |
|---|---|---|---|
| 3739937 | 6/1989 | Japan | 123/468 |
| 5-195906 | 8/1993 | Japan | 123/468 |
| 6-137231 | 5/1994 | Japan | 123/468 |
| 668621 | 1/1989 | Switzerland . | |
| 2097858 | 11/1982 | United Kingdom . | |

*Primary Examiner*—Carl S. Miller

*Attorney, Agent, or Firm*—Flynn, Thiel, Boutell & Tanis, P.C.

[57] ABSTRACT

A fuel-injection system for an internal combustion engine and in particular, for a diesel motor has at least one injection element for each combustion cylinder controlled from a control device, which injection element has an injection opening extending into the cylinder and closable by same, and a pressure chamber arranged in front of said injection opening, which pressure chamber is connected to a high-pressure part supplied by a fuel pump in dependency on the motor speed, load and load change. The injection amount of the fuel into the combustion cylinder can be supplied by means of a metering device preferably connected in front of the fuel pump and operable by the control device. The metering device has a 2/2-way valve connected in front of the fuel pump designed as a radial piston pump, which 2/2-way valve opens or rather closes during suction in order to achieve the desired fuel injection amount in dependency on the position of the pump piston of the fuel pump. With this arrangement it is in particular prevented together with the monitoring of the pressure in the high-pressure part on the one hand that one or several combustion cylinders do not operate over a longer period of time in an insufficient operating condition and on the other hand that greater motor damages through defects in particular in the injection elements also can be avoided. With this the fuel consumption and also the noise and polluting emissions can be kept to an absolute minimum.

16 Claims, 3 Drawing Sheets

FUEL-INJECTION SYSTEM FOR AN INTERNAL COMBUSTION ENGINE, IN PARTICULAR FOR A DIESEL MOTOR, AND A METHOD FOR MONITORING THE SAME

FIELD OF THE INVENTION

The invention relates to a fuel-injection system for an internal combustion engine, in particular for a diesel motor, comprising at least one injection element for each combustion cylinder controlled from a control device, which injection element has an injection opening that can be closed and extends into the cylinder, and a pressure chamber arranged in front of said injection opening, which pressure chamber is connected to a high-pressure part supplied by a fuel pump in dependency on the motor speed, load and load change and also relates to a method for monitoring the fuel-injection system.

BACKGROUND OF THE INVENTION

In a conventional fuel-injection system according to CH-A5 668 621, the injection amount, with the opening cross section of the injection opening being given, is determined primarily by the fuel pressure existing in front of the opening valve. It is thereby supplied constantly or to a certain degree variably by changing the pressure corresponding with the injection pressure map fixed in a control device. It is hereby a disadvantage that through wear or obstruction of an opening cross section the injection amount changes almost linearly and thus influences the resulting motor torque. This cannot be detected by the injection system, for example, just like, tears in the area of the injection opening or also a breakage of a nozzle tip cannot be detected. This conventional injection system furthermore has inadequacies during accumulation of excessive oil-leakage amounts, for example, during a line breakage. It is possible in such cases for large amounts to escape unnoticed into the environment. Damage to the nozzle tip or other breakdowns of the injection valves possibly may not be recognized in this common injection system and can endanger users. Furthermore the problem exists in large-volume diesel motors that an abrasive, very inexpensive heavy oil is used for the control of the injection elements. Practice has shown that because of this heavy oil a satisfactory functioning of these injection elements over a longer period of time is not guaranteed.

The purpose of the present invention is to provide a fuel-injection system according to the above-described type, by means of which changes or damages within the system can be immediately recognized and corrected, to thereby achieve an optimum behavior of the internal combustion engine with respect to fuel consumption, noise and pollution emissions, and in addition, to overcome the additional above-mentioned disadvantages.

SUMMARY OF THE INVENTION

The purpose is attained according to the invention by determining the injection amount of the fuel into the combustion cylinder by means of a metering device and thereby metering the amount.

With this inventive metering of the injection amount it is possible in comparison with known common rail fuel-injection system to introduce amounts that are metered very exactly into a cylinder and thus to achieve an optimum air-fuel ratio therein. With this it is possible to keep the fuel consumption and also the noise and pollution emissions to an absolute minimum. When at the same time the amount is additionally metered at the injection valves, relatively small changes compared with the desired course can already be clearly detected during the injection operation. Thus on the one hand, one or several combustion cylinders are prevented from operating insufficiently over a longer time period and on the other hand, defects, in particular in the injection elements, can be found or even compensated for, which otherwise would cause greater damage to the motor.

The metering of the amount is done advantageously with a conventional flow regulator or a 2/2-way valve, which opens or rather closes in dependency on the piston position of a fuel pump which is provided as a radial piston pump.

A line or conduit is provided in a preferred embodiment, which starts out from a feed pump, is connected parallel to the fuel pump, extends into the high-pressure part, and has a check valve, with which line a ventilation or rather a pressure build-up of the high-pressure part through the preferably electrically operated feed pump is made possible. This results in a great advantage when compared with the known diesel motors such that the high-pressure part can be returned very quickly again to a certain pressure after emptying because of a service or the like, whereas in the typical diesel motors this had to be done by means of the high-pressure pump. This is very time-consuming because this pump can only move small amounts in relationship to the volume formed by the high-pressure part.

The pressure store and the high-pressure lines or conduits of the high-pressure part advantageously are enclosed by a tubular sleeve which forms an annular gap and ends in the fuel tank, thus being able to avoid fuel losses and environmental contaminations resulting therefrom during leakages in this high-pressure part.

Furthermore it is possible in the case of large-volume internal combustion engines, as for example in a ship or stationary current-producing drives which operate with heavy oil as fuel, to associate a fuel pump with the injection elements for metering of the amount of heavy oil and a separate high-pressure pump, with or without a metering of the amount, for the control of the injection elements. The high-pressure pump produces for the control cycle a pressure corresponding approximately with the fuel pump. The control liquid pressure is advantageously slightly higher. By using a separate medium for the control of the injection element, the injection element can be serviced less frequently. In known systems in which an abrasive fuel also is used, difficulties occur during start-up on the one hand when same is still cold and thus very viscous, and on the other hand this fuel causes quick wear of the highly sensitive control elements and moreover causes obstructions of the same.

BRIEF DESCRIPTION OF THE DRAWINGS

Preferred embodiments of the invention and further advantages of the same will be discussed in greater detail hereinafter in connection with the drawings, in which.

DETAILED DESCRIPTION

Figure 1:
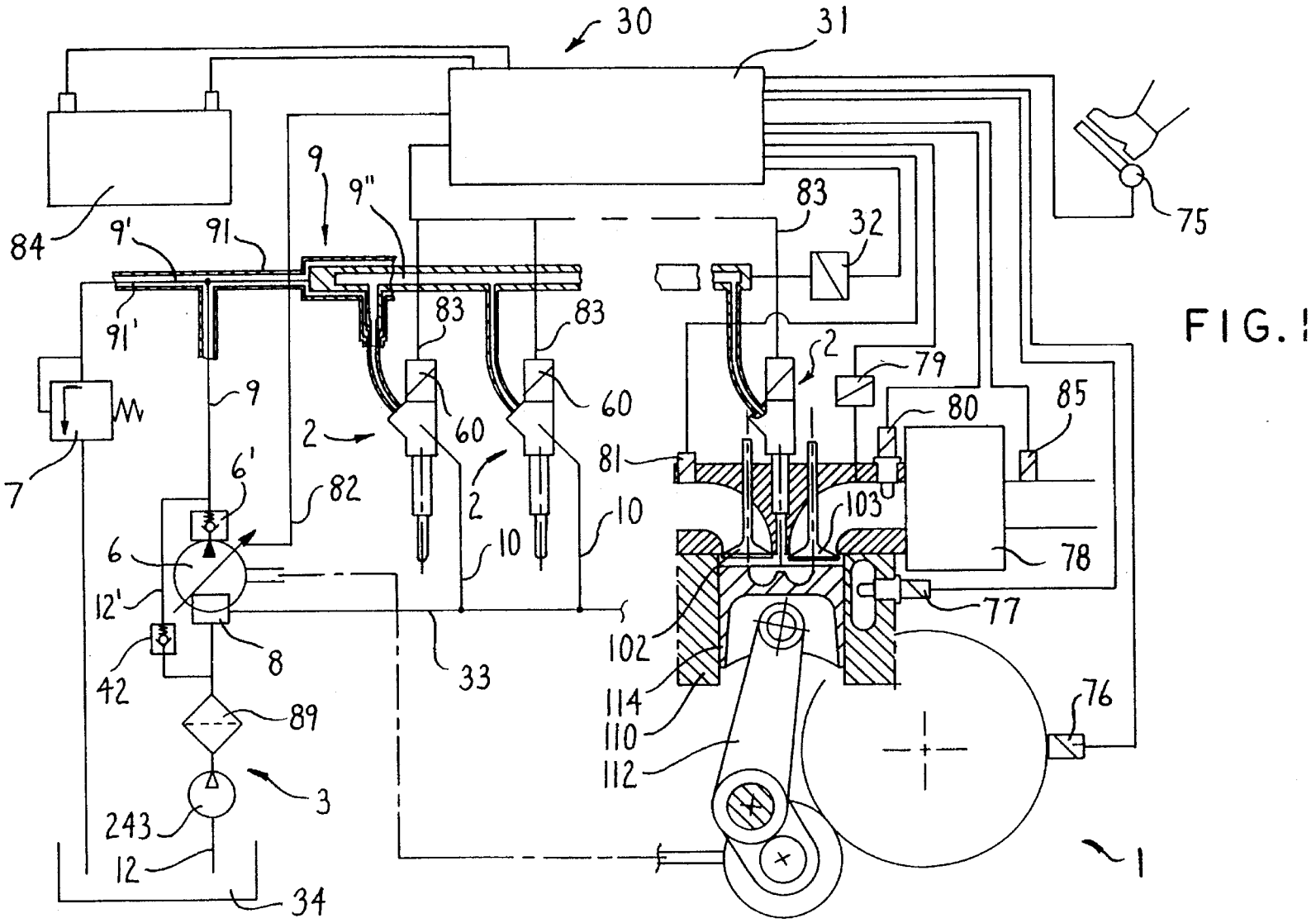
FIG. 1 is a schematic illustration of an injection system of a diesel motor.

FIG. 1 illustrates a fuel injection system 30 for a diesel motor 1 of a motor vehicle, which diesel motor is provided as an internal combustion engine and has several combustion cylinders 110, one of which is shown together with the crankshaft assembly 112 for the piston 114. The crankshaft assembly is known and is therefore not discussed in detail hereinafter. An injection element 2 and a suction and discharge valve arrangement 103, 102 are provided for each combustion cylinder 110. This and all the other known parts of this system do not need to be discussed in detail. A fuel-supply device 3, a central control device 31 and a storage battery 84 supplying said control device with electricity are furthermore provided in this internal combustion engine.

The diesel motor 1 is controlled with the central control device 31 in accordance with the gas pedal 75 operated by a driver and further operating elements not illustrated in detail. For this purpose, it is active in a conventional manner as a control 83 for the magnetic valves 60 of the injection elements 2, as a control 82 for the fuel pump 6 and for further receivers also not illustrated in detail. In addition, besides the driving-pedal signal, the central control device 31 mainly processes the position signal or signals 76, further signals 32 of the fuel pressure in the high-pressure part 9, which signals 32 are needed for fine corrections, signals 79, 80, 81, 85 for the air, pressure and temperature conditions prior to combustion or rather in the exhaust gas state. The signals can thereby be processed as digital or analog signals.

Figure 2:
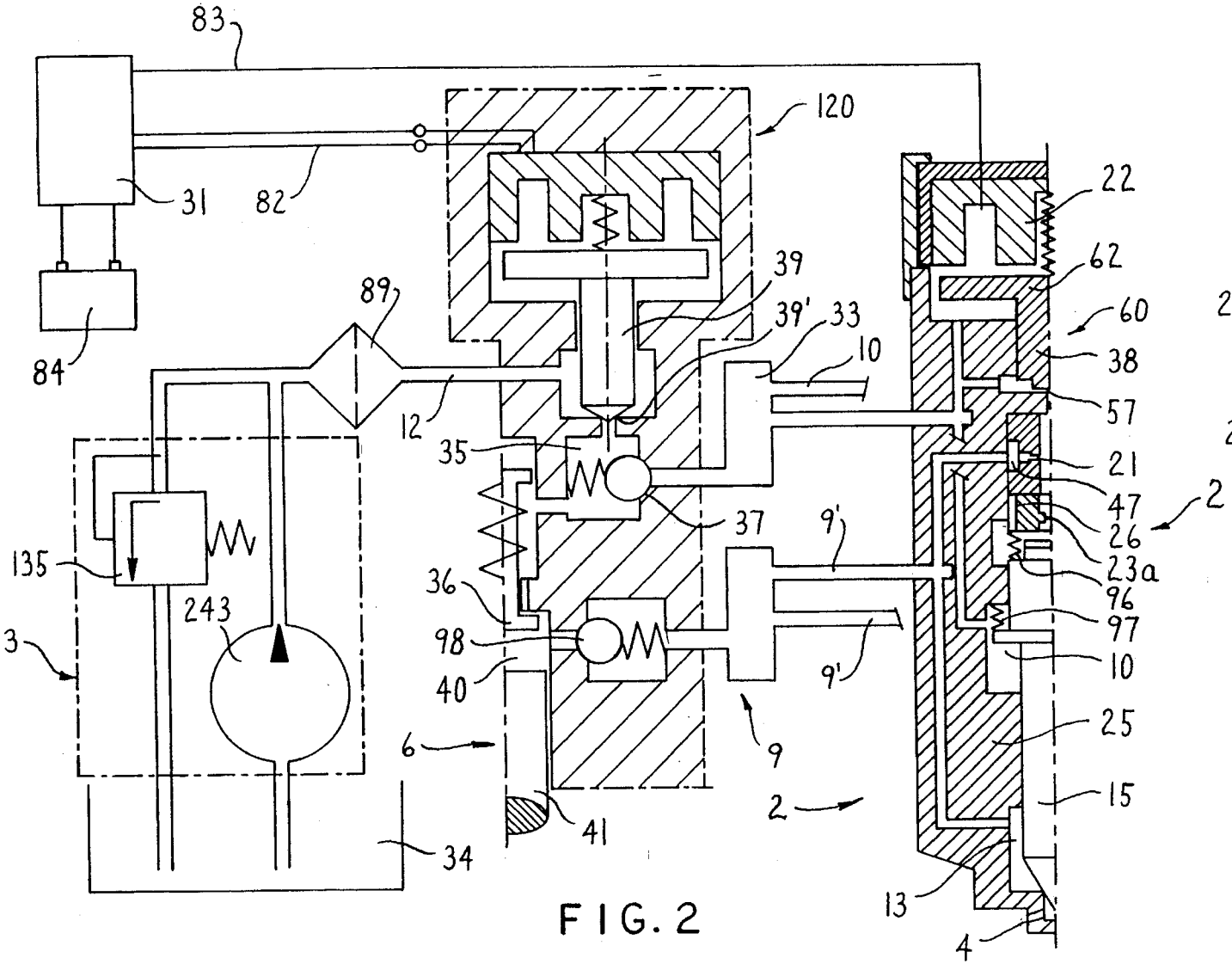
FIG. 2 is a schematic illustration of a metering device, a fuel pump disposed after the metering device and an injection element each illustrated in a cross-sectional view.
Figure 4:
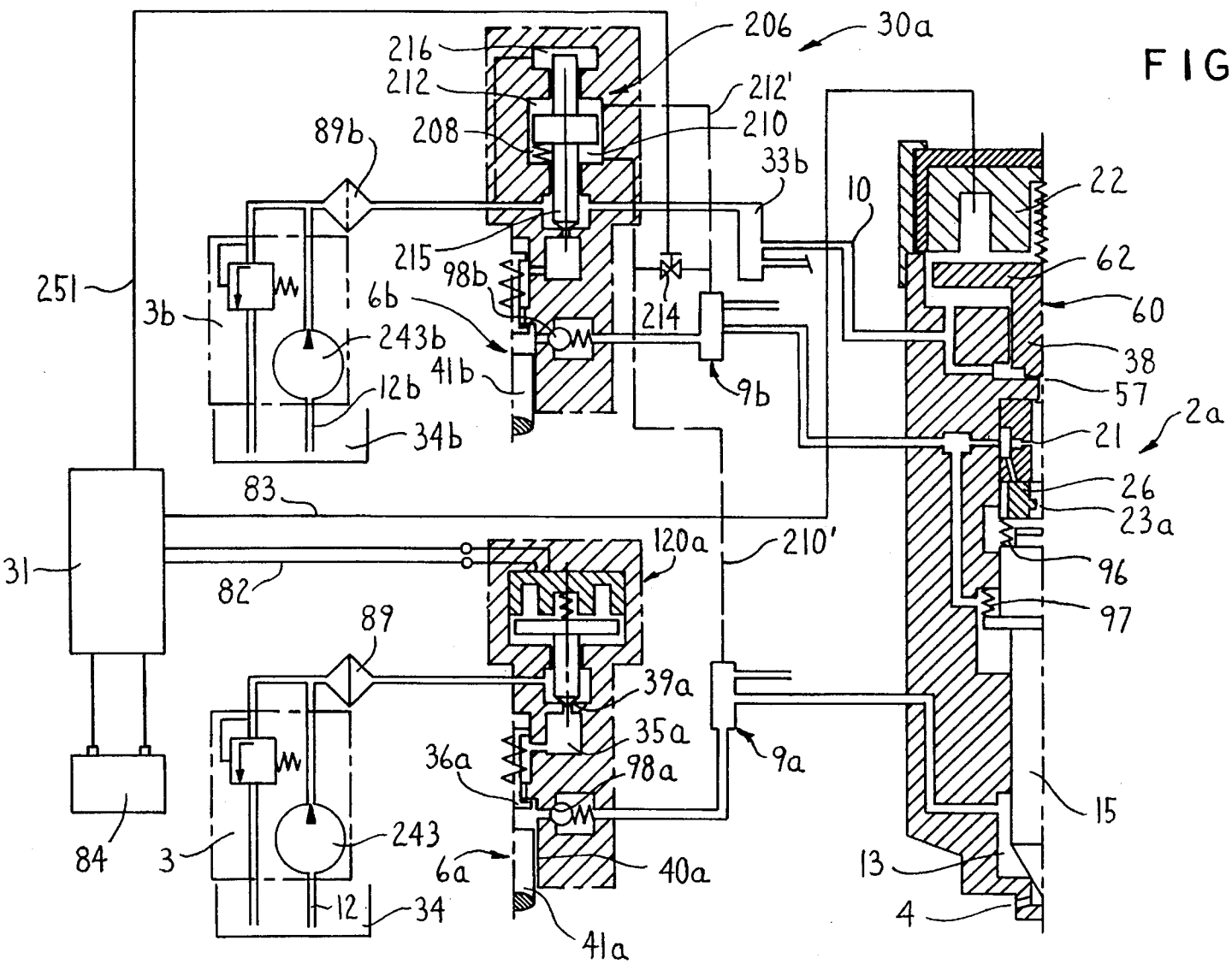
FIG. 4 is a schematic illustration of a metering device and a fuel pump after the metering device for the fuel supply or rather a high-pressure pump with quantity metering for the control of the illustrated injection element each illustrated in a half cross section.

The fuel-supply device 3 includes a fuel tank 34, a line or conduit 12 starting from said tank, a feed pump 243, a fine filter 89 and a fuel pump 6, which moves the fuel with a high pressure ranging from 200 bar up to 2000 bar through a check valve 6' and a line or conduit 9' into the high-pressure part 9, which has a chamber 9". As generally illustrated in FIGS. 2 and 4, this high-pressure part 9 is connected to a pressure chamber 13 contained in each injection element 2, which pressure chamber is arranged directly in front of an injection opening 4 extending into the cylinder 110 and closable by a valve member 15. Referring to FIG. 1, the line or conduit 9' furthermore is connected through a pressure-limiting valve 7 to the fuel tank 34 for safety reasons. The fuel pump 6, which supplies several injection elements 2, is controlled by the control device 31 in such a manner that it operates in dependency of the motor speed, load and load change, and pumps the fuel at a high speed and high load as a rule to a high pressure, whereas at a low load and low speed to a low pressure.

The injection amount of the fuel into the combustion cylinder can be supplied according to the invention by means of a metering device operated by the control device. This metering device thereby is constructed as a flow regulator 8 connected in front of the high-pressure pump 6, which flow regulator 8 has a throttle valve operable by the control device with or without a position feedback of the valve member or a timed closing valve. To achieve a constant pressure difference in the metering valve, a pressure-correcting throttle valve can be associated with said throttle valve and connected thereafter in series, which pressure-correcting throttle valve will be described hereinafter in detail in connection with FIG. 3.

As seen in FIG. 1, the fuel pump 6 thereby delivers a fuel amount which is adjusted to the number of injection elements fed by it and the desired injection amount. It also delivers an additional amount of fuel, which is necessary for a pressure change in the entire line or conduit system communicating with it, because primarily during a quick fuel-pressure change, the amount which the pump feeds differs significantly from the medium injection amount. This is necessary because an additional amount is needed during changes in the conditions which result from a change of the injection pressure. The injection duration of the fuel into the cylinder, which duration is determined by the control device 31, and the metering of the injection amount at the metering device must be adjusted to one another. The control device 31 is thereby designed such that in the ideal case with the control device 31 the injection amount, which is produced by the metering device, together with the programmed control time of the injection valves results exactly in the desired injection pressure so that an optimum fuel supply takes place at all times. This means that when the amount determined by the injection elements and the leakage thereof is compared to the amount determined by the flow regulator and the amounts do not correspond, this results in an injection pressure deviating from the desired pressure. The less reliable correcting element, usually one of the injection elements 2, can, for example, be determined by means of conventional rotation-uniformity detection and depending on the severity of the deviation receives a corrected control duration or is switched off. Also, a correction of the amount controlled at the flow regulator is then necessary in the latter case. When metering the injection amount per injection, an additional feed amount must, if necessary, be supplied, which corresponds with the temperature-dependent and pressure-dependent leakage behavior of the system. However, when the leakage amount resulting from the control of the injection elements and also the leakage flows on the side of the system are returned through an oil-leakage collecting line or conduit 33 between the metering device 8 and the fuel pump 6, such additional feed amount is not necessary. Only an additional amount must then be solely considered for the pressure changes in the entire high-pressure system.

Furthermore a line or conduit 12', which starts out at the feed pump 243, is connected in parallel with the fuel pump 6, and extends into the high-pressure part 9. The line 12' has a check valve 42 which is provided, with which line 12' a ventilation or rather pressure build-up of the high-pressure part 9 is made possible through the preferably electrically driven feed pump 243. Furthermore the pressure store 9" and the high-pressure lines or conduits 9' of the high-pressure part 9 are enclosed by a tubular sleeve 91 which forms an annular gap 91' and ends in the fuel tank 34. Leakage can, if necessary, be collected in this manner from this high-pressure part and in addition, can be immediately detected through a monitoring device not illustrated in detail.

FIG. 2 illustrates an injection element 2, a fuel pump 6 supplying same, in front of which fuel pump is connected a metering device 120. The fuel pump 6 is controlled by the control device 31 and is fed with fuel by means of the feed pump 243 through a line or conduit 12 starting out from the fuel tank 34. A pressure-regulating valve 135, which is connected parallel to said feed pump 243 and, ensures a constant supply pressure of the fuel being guided into the metering device 120.

This metering device 120 has a 2/2-way valve 39, which opens or closes in dependency on the position of the pump piston 41 of the fuel pump 6 in order to achieve the desired fuel-injection amount. This valve 39, which is connected to the control device 31 through connecting lines 82, preferably is opened with the piston 41 in the upper position thereof until same is moved in a suction direction over a defined stroke, for example, by the position of the crankshaft assembly 112, and the suctioned amount corresponds with the desired amount. A volumetrically defined, very exact injection amount can thus be produced in a simple manner. The fuel moves from the valve opening 39' into a chamber 35 and from there through a check valve 36 into the fuel pump 6. Moreover an oil-leakage collecting line 33 extends advantageously into this chamber 35, through which collecting line 33 returns the leakage from the injection element 2 and from the system, which returns to the line 33 from a line or conduit 10. A check valve 37 between the chamber 35 and the oil-leakage collecting line 33 has the effect that when the valve 39 is open the connection to the oil-leakage collecting line 33 temporarily is interrupted through the increasing pressure. As soon as the valve 39 is closed and the suction of the fuel pump 6 continues, then the pressure in the chamber 35 is reduced significantly, the check valve 37 opens and accumulated leakage oil in the line 33 is thus suctioned in an subsequently moved into the high-pressure part 9. This arrangement results in a closed cycle of the leakage oil and thus a magnitude for an additional feed amount does not need to be fed to the control device 31. Therefore, different leakage amounts of the injection elements, which leakage amounts are caused by tolerance and other components no longer influence the metering of the amount at the pump.

It is also possible to connect the 2/2-way valve 39 directly in front of the fuel pump 6 instead of the check valve 36. The leakage-oil collecting line 33 would then, for example, extend back into the fuel tank. The oil-leakage losses which no longer exist and the desired injection amount would in this embodiment then have to be conveyed additionally during the metering of the feed amount. The leakage oil could, however, also alternatively be returned through a separate suction valve functioning at the same time as a pressure-difference valve and directly into one or several pump cylinders 40.

The fuel flows from the fuel pump 6 quasi-continuously into the high-pressure part 9 and from there into the pressure chamber 13 or rather into the control part of the injection element 2. The latter is designed in a typical manner and therefore is not described in detail. A magnetic valve 60 has a magnetic core 22 operable by the control device 31 and a magnetic anchor 62 with a valve member 38, and is fastened on the upper end of a housing 25. The line 9' coming from the high-pressure part 9 branches off in front of the injection opening 4 on the one side into the pressure chamber 13 and on the other side into an annular chamber 47, which is defined on the inside by a valve member arranged in this housing 25. Said valve member is followed by a movable valve member 26 and a nozzle needle 15 closing the injection opening 4, which nozzle needle is shown in the closed state. A pressure reduction is created above the nozzle needle 15 during opening of the magnetic valve 60 which is caused by the fuel flowing off through the opening 57, thereby causing the nozzle needle to be lifted off by the remaining pressure in the chamber 13 and thus permitting fuel to flow through the injection opening 4 into the combustion cylinder. The cooperation of the nozzle needle 15 with the valve member 26 effects an optimum opening or closing speed of the nozzle needle. Pressure springs 96, 97 are additionally arranged for this purpose between these and the nozzle needle 15 and the housing 25, which effect a spring force in a closing direction of the nozzle needle. Lines or conduits 10 for accumulating leakage oil in the injection element 2 exist furthermore in the housing 25.

Figure 3:
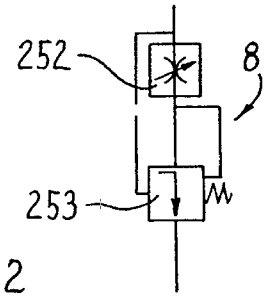
FIG. 3 shows a hydraulic diagram of a metering device designed as a flow regular.

The flow regulator 8 is illustrated in detail in FIG. 3. It has a controllable throttle valve 252 and a pressure-correcting throttle valve 253 thereafter connected in series, with the throttle valve 252 advantageously being formed of a needle valve with a long-stroke operating magnet and with or without a position feedback of the same. To achieve a constant pressure difference above the valve 252, the pressure-correcting throttle valve 253 is provided in front of or, as illustrated, after the first one, which balancingly changes its flow cross section depending on the pressure drop above the throttle valve 252. The throttle valve 252 in this manner delivers the desired injection amount and, if necessary, an additional feed amount to balance leakage losses by controlling its flow cross section. In place of a throttle valve it would also be possible to use a timed closing valve, which would deliver the desired injection amount preferably at a given timed frequency through suitable pulse-width modulation.

FIG. 4 shows a fuel-injection system **30*a* having a fuel pump 6*a* with a metering device 120*a* for the fuel and a high-pressure pump 6*b* separated therefrom with or without metering. The amount of a separate medium for the control of the injection elements 2*a* is essentially associated with said injection elements 2*a*, with the high-pressure pump 6*b* producing a pressure corresponding approximately with the fuel pump 6*a*, although preferably slightly higher so that flow of heavy oil in the injection element is prevented from flowing into the control part. Only the characteristics of this system 30*a* differing from the system discussed in detail above are described. Thus the injection element 2*a* has a supply line or conduit of the high-pressure part 9*a* of the fuel pump 6*a*, which supply line extends into the pressure chamber 13, and has a separate supply line or conduit of the high-pressure part 9*b*. This injection element 2*a* functions otherwise analogously with the one according to FIG. 2. An externally controlled metering of the medium preferably is not provided for the high-pressure pump 6*b*, but instead only a pressure is produced in its high-pressure part 9*b*, which is at all times slightly higher than the one of the high-pressure part 9*a* of the fuel pump 6*a*. A valve 206 is for this purpose connected in front of the high-pressure pump 6*b*, which valve forms a double-acting piston/cylinder system. The chambers 210 and 212 of the valve 206 have a line connection 210' to the higher-pressure part 9*a* or rather a line connection 212' to the high-pressure part 9*b*. A pressure spring 208 furthermore is arranged in the first one, through which spring the aforementioned higher pressure in the high-pressure part 9*b* is secured. The valve member 215 forming the piston extends with is upper end into a further chamber 216 and is connected to the line or conduit 12*b* of the feed pump 243*b* for guiding the medium from the container 34*b* to the high-pressure pump 6*b*. A swinging of the valve member 215 can be prevented with the throttle action of this connection and of the lines 210' and 212'. With a 2/2 switch valve 214 that is operable by the control device 31 through a signal line 251 it is possible to flush the high-pressure container 9*a* and the chamber 13 in the injection valve 2*a* with control fluid at the end of the feeding of the pump 6*a*, for example diesel fuel. The motor thus is operated in a conventional manner. It permits a low-emission operation, for example in waters near the coast and permits a quicker starting of the motor after a longer switch-off period. Moreover, damage of components in the injection elements 2***a* can be prevented with the mentioned short-circuit.

This fuel-injection system 30*a* is particularly suited for large-volume internal combustion engines, which are mainly utilized for ship drives or stationary current production, in which the fuel costs are of decisive importance. Abrasive heavy oil thereby is often used, which is very aggressive and therefore significantly changes the characteristics of the injection openings during the length of operation. Even after the mentioned wear, an optimum injection in particular of the injection openings can especially be achieved hereby with the inventive metering of the amount. Moreover there exists the requirement in these internal combustion engines that high reliability and long service intervals be met, which is completely met with the arrangement of the invention according to FIG. 4.

In all preferred embodiments according to the above description, the pressure is measured by the control device 31 in the high-pressure part 9 connected to the injection element 2 and is there compressed with a desired pressure. When a deviation is found, the injection amount or the performance of the fuel pump is changed to correct it and/or an emergency program is switched on. In the case of small deviations of the injection pressure, the injection amount is, for example, first adjusted to the injection elements by correcting the injection duration. If individual injection elements are recognized as being responsible for these deviations, the correction takes place only on these. In the case of larger deviations, a correction of the pump-feed amount also takes place, or an injection element is completely switched off and the pump-feed amount is adjusted to the lesser active number of cylinders. In the worst case, a minimal emergency program is utilized, which with a reduced performance should make possible a trip to the service station.

The metering device for determining the fuel-injection amount can moreover be realized through a conventional adjustable fuel pump, in which the desired feed amount is metered directly on it without a metering valve connected in front or after it.

I claim:

1. In a fuel-injection system for an internal combustion engine, which includes at least one combustion cylinder, comprising a control device, a fuel pump, a high-pressure part supplied with fuel by said fuel pump in dependency on the motor speed, load and load change of said engine, and at least one injection element for each said combustion cylinder controlled from said control device for injecting an injection amount of said fuel into said combustion cylinder, said injection element having an injection opening in communication with said combustion cylinder, means for opening and closing said injection opening and a pressure chamber arranged upstream of said injection opening in communication therewith, said pressure chamber being in communication with said high-pressure part so as to receive said fuel from said fuel pump, comprising the improvement wherein said injection amount of said fuel being injected into said combustion cylinder is determined by means of a metering device, said metering device being constructed as a flow controller connected upstream of said fuel pump and having a first throttle valve operable by said control device, a pressure-correcting second throttle valve being arranged in series in combination with said first throttle valve, said pressure-correcting second throttle valve being adapted to balancingly change the pressure drop above said first throttle valve so that there always exists the desired required pressure over said flow regulator.

2. In a fuel-injection system for an internal combustion engine, which includes at least one combustion cylinder, comprising a control device, a fuel pump, a high-pressure part supplied with fuel by said fuel pump in dependency on the motor speed, load and load change of said engine, and at least one injection element for each said combustion cylinder controlled from said control device for injecting an injection amount of said fuel into said combustion cylinder, said injection element having an injection opening in communication with said combustion cylinder, means for opening and closing said injection opening and a pressure chamber arranged upstream of said injection opening in communication therewith, said pressure chamber being in communication with said high-pressure part so as to receive said fuel from said fuel pump, comprising the improvement wherein said injection amount of said fuel being injected into said combustion cylinder is determined by means of a metering device, said metering device having a 2/2-way valve connected upstream of said fuel pump, said fuel pump being a radial piston pump having a pump cylinder and a pump piston operatively engaged with said pump cylinder to provide a suction for pumping said fuel, said 2/2-way valve being adapted to open or close in dependency on the position of said pump piston of said fuel pump during said suction.

3. The fuel injection system according to claim 2, wherein said 2/2-way valve is provided as a separate valve and wherein a chamber and a check valve are thereby arranged between said 2/2-way valve and said pump cylinder.

4. The fuel-injection system according to claim 3, wherein a feed pump supplies said fuel to said metering device upstream of said fuel pump and a line is provided starting out from said feed pump, connected in parallel with respect to said fuel pump and extending to said high-pressure part in communication therewith, said line provided with a check valve, and facilitating a pressure build-up in said high-pressure part by said feed pump.

5. In a fuel-injection system for an internal combustion engine, which includes at least one combustion cylinder, comprising a control device, a fuel pump, a high-pressure part supplied with fuel at a controlled pressure by said fuel pump in dependency on the motor speed, load and load change of said engine, and at least one injection element for each said combustion cylinder controlled from said control device for injecting an injection amount of said fuel into said combustion cylinder, said injection element having an injection opening in communication with said combustion cylinder, means for opening and closing said injection opening and a pressure chamber arranged upstream of said injection opening in communication therewith, said pressure chamber being in communication with said high-pressure part so as to receive said fuel from said fuel pump, comprising the improvement wherein said injection amount of said fuel being injected into said combustion cylinder is determined by means of a metering device which is adapted to measure said injection amount, and wherein said metering device is adapted to supply during measuring of said injection amount, an additional feed amount at said fuel pump per injection of said injection amount into said combustion chamber, said additional feed amount corresponding with the temperature and pressure-dependent leakage behavior of the system and the amount needed for effecting a pressure change in said high pressure part.

6. In a fuel-injection system for an internal combustion engine, which includes at least one combustion cylinder, comprising a control device, a fuel pump, a high-pressure part supplied with fuel by said fuel pump in dependency on the motor speed, load and load change of said engine, and at least one injection element for each said combustion cylinder controlled from said control device for injecting an injection amount of said fuel into said combustion cylinder, said injection element having an injection opening in communication with said combustion cylinder, means for opening and closing said injection opening and a pressure chamber arranged upstream of said injection opening in communication therewith, said pressure chamber being in communication with said high-pressure part so as to receive said fuel from said fuel pump, comprising the improvement wherein said injection amount of said fuel being injected into said combustion cylinder is determined by means of a metering device which includes a 2/2 way valve, an oil-leakage collecting line being provided for receiving a leakage amount originating from said injection element during the control of said injection element, said collecting line extending from said injection element into a chamber for the pump suction, which said chamber is disposed in communication between said metering device and said fuel pump, so that after said closing of said 2/2-way valve said fuel pump only suctions said leakage oil from the oil-leakage collecting line.

7. The fuel-injection system according to claim 6, wherein said oil-leakage collecting line extends through a valve, which is one of a check valve and a differential pressure valve, into said chamber.

8. In a fuel-injection system for an internal combustion engine, which includes at least one combustion cylinder, comprising a control device, a fuel pump, a high-pressure part supplied with fuel by said fuel pump in dependency on the motor speed, load and load change of said engine, and at least one injection element for each said combustion cylinder controlled from said control device for injecting an injection amount of said fuel into said combustion cylinder, said injection element having an injection opening in communication with said combustion cylinder, means for opening and closing said injection opening and a pressure chamber arranged upstream of said injection opening in communication therewith, said pressure chamber being in communication with said high-pressure part so as to receive said fuel from said fuel pump, comprising the improvement wherein said injection amount of said fuel being injected into said combustion cylinder is determined by means of a metering device, each said injection element being in communication with said fuel pump and a high-pressure pump, said fuel pump connected to said metering device for injecting said injection amount of said fuel through said injection opening and said high-pressure pump separated therefrom for pumping a separate medium for the control of said injection element.

9. The fuel-injection system according to claim 8, wherein a pressure which is produced by said high-pressure pump that controls said injection element and acts on said separate medium is higher than a pressure from said fuel pump which acts on said fuel.

10. In a fuel-injection system for an internal combustion engine, which includes at least one combustion cylinder, comprising a control device, a fuel pump, a high-pressure part supplied with fuel by said fuel pump in dependency on the motor speed, load and load change of said engine, and at least one injection element for each said combustion cylinder controlled from said control device for injecting an injection amount of said fuel into said combustion cylinder, said injection element having an injection opening in communication with said combustion cylinder, means for opening and closing said injection opening and a pressure chamber arranged upstream of said injection opening in communication therewith, said pressure chamber being in communication with said high-pressure part so as to receive said fuel from said fuel pump, comprising the improvement wherein said injection amount of said fuel being injected into said combustion cylinder is determined by means of a metering device, said metering device for determining said injection amount of the fuel injection being an adjustable fuel pump, in which a desired feed amount is metered.

11. A method for monitoring a fuel-injection system for an internal combustion engine, which includes at least one combustion cylinder, said fuel-injection system comprising a control device, a fuel pump, a high-pressure part supplied with fuel by said fuel pump in dependency on the motor speed, load and load change of said engine, and at least one injection element for each said combustion cylinder controlled from said control device for injecting an injection amount of said fuel into said combustion cylinder, said injection element having an injection opening in communication with said combustion cylinder, means for closing said injection opening and a pressure chamber arranged upstream of said injection opening in communication therewith, said pressure chamber being in communication with said high-pressure part so as to receive said fuel from said fuel pump, and said injection amount of said fuel being injected into said combustion cylinder being determined by means of a metering device, said method comprising the steps of measuring a pressure in said high-pressure part which is connected to said injection element, comparing said measured pressure with a desired pressure, and when a deviation is found, correctingly changing an opening duration of said injection element and then said injection amount of said fuel pump.

12. The method for monitoring a fuel-injection system according to claim 11, wherein when a deviation of the pressure in said high-pressure part occurs outside of a selectable tolerance limit and is determined to have occurred or a recognizable defective behavior of said injection element through nozzle-peak breakage or cable breakage is determined to have occurred, said injection element is switched off, the pump-feed amount is correspondingly adjusted and the driver receives a warning or an indication of the location of the defect.

13. The fuel injection system according to claim 2, wherein said 2/2-way valve is connected directly upstream of said pump cylinder of said fuel pump.

14. The fuel-injection system according to claim 6, wherein said oil-leakage collecting line extends through a valve, which is one of a check valve and a differential pressure valve, directly into a pump cylinder of said fuel pump.

15. In a fuel-injection system for an internal combustion engine, which includes at least one combustion cylinder, comprising a control device, a fuel pump which includes a check valve permitting passage of fuel therethrough during suction by said fuel pump, a high-pressure part disposed downstream of said fuel pump which is constantly under high pressure and is supplied with fuel by said fuel pump in dependency on the motor speed, load and load change of said engine, and at least one injection element for each said combustion cylinder controlled from said control device for injecting an injection amount of said fuel received from said high-pressure part into said combustion cylinder, said injection element having an injection opening in communication with said combustion cylinder, means for opening and closing said injection opening and a pressure chamber arranged upstream of said injection opening in communication therewith, said pressure chamber of each said injection element being connected to said high-pressure part so as to receive said fuel from said fuel pump, comprising the improvement wherein a metering device is disposed upstream of said check valve in communication therewith, said injection amount of said fuel into said combustion cylinder being a set volume of said fuel defined by said control device and being determined by means of said metering device operated in response to said control device.

16. The fuel-injection system of claim 15, wherein said fuel metering device is designed as a flow controller located upstream of said check valve of said fuel pump, said flow controller being defined by a throttle valve operated by said control device and means for holding constant a pressure drop over said throttle valve in order to provide a fuel flow independent from the pressure upstream of said check valve.

* * * * *